US006530680B2

(12) United States Patent
Sipala

(10) Patent No.: US 6,530,680 B2
(45) Date of Patent: Mar. 11, 2003

(54) UTILITY FLOOD LIGHT

(76) Inventor: Arthur E. Sipala, 1263 W. Kings Hwy., Coatesville, PA (US) 19320

( * ) Notice: Subject to any disclaimer, the term of this patent is extended or adjusted under 35 U.S.C. 154(b) by 0 days.

(21) Appl. No.: 09/846,553

(22) Filed: May 1, 2001

(65) Prior Publication Data

US 2002/0163811 A1 Nov. 7, 2002

(51) Int. Cl.[7] ..... F21V 21/30

(52) U.S. Cl. ..... 362/398; 362/287; 362/418; 362/413

(58) Field of Search ..... 362/427, 398, 362/410, 413, 414, 418, 287, 371

(56) References Cited

U.S. PATENT DOCUMENTS 3,187,170 A * 6/1965 Kille ..... 362/371
5,184,891 A * 2/1993 Shpigel ..... 362/419
D345,026 S 3/1994 Pottebaum
5,408,399 A 4/1995 Atkins et al.
5,490,046 A * 2/1996 Gohl et al. ..... 362/35
5,493,484 A 2/1996 Osteen et al.
D380,568 S 7/1997 Landy

* cited by examiner

*Primary Examiner*—Sandra O'Shea
*Assistant Examiner*—Anabel Ton
(74) *Attorney, Agent, or Firm*—Sturm & Fix LLP

(57) ABSTRACT

A utility flood light having a cone-shaped lamp housing, a magnetic base, and a handle interconnecting the base and the lamp housing. The housing is positioned and locked in a selected angular orientation with respect to the handle with a gear locking mechanism. A lamp is secured in the housing and is powered through an electrical cord coupled to a power source.

3 Claims, 1 Drawing Sheet

UTILITY FLOOD LIGHT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of flood lights, and more particularly to a utility flood light with a cone-shaped housing for the lamp and a magnetic base.

2. Description of Related Art

As can be seen by reference to the following U.S. Pat. Nos. D345,026; D380,568; 5,408,399 and 5,493,484, the prior art is replete with myriad and diverse flood light assemblies.

While all of the aforementioned prior art constructions are more than adequate for the basic purpose and function for which they have been specifically designed, they are uniformly deficient with respect to their failure to provide a simple, efficient, and practical utility flood light with a cone-shaped housing for the lamp and a magnetic base.

As a consequence of the foregoing situation, there has existed a longstanding need for a new and improved utility flood light and the provision of such a construction is a stated objective of the present invention.

BRIEF SUMMARY OF THE INVENTION

Briefly stated, the present invention provides a utility flood light having a cone-shaped lamp housing, a magnetic base, and a handle interconnecting the base and the lamp housing. The housing is positioned and locked in a selected angular orientation with respect to the handle with a gear locking mechanism. A lamp is secured in the housing and is powered through an electrical cord coupled to a power source.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2:
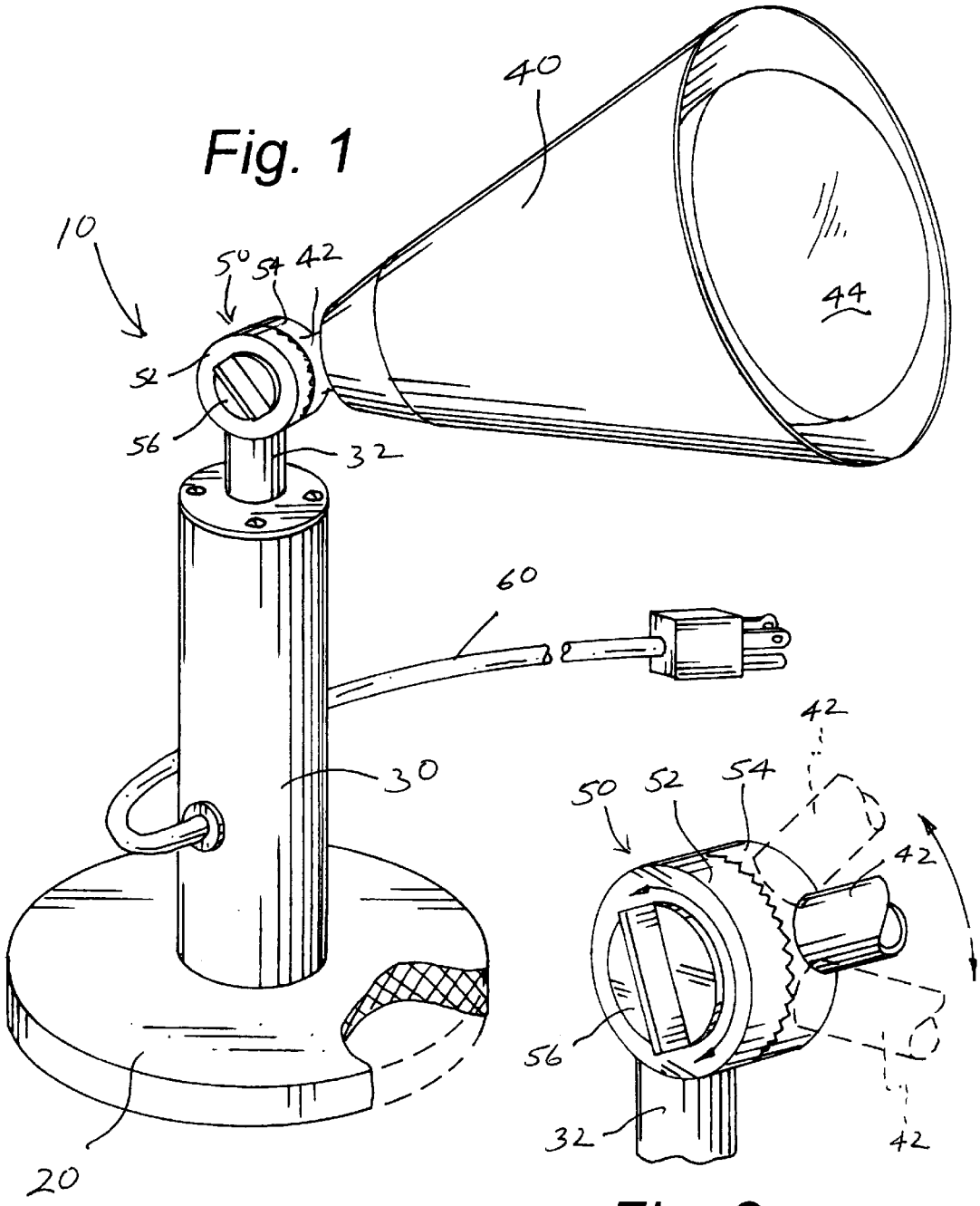
FIG. 1 is a perspective view of the utility flood light of the present invention with a portion cut away to illustrate the magnetic base.
FIG. 2 is a partial perspective view showing the gear locking adjustment that allows the adjustment of the angle of the lamp housing with respect to the handle.

As can be seen by reference to the drawings, and in particularly to FIG. 1, the utility flood light that forms the basis of the present invention is designated generally by the reference number 10. The flood light 10 includes a large magnetic base 20 and a handle 30 that is attached to and extends up from the base 20. A cone-shaped lamp housing 40 is pivotally attached to the handle 30 and is movable with respect thereto as illustrated in FIG. 2. A locking mechanism 50 includes a first gear plate 52 attached to an upper extension 32 of the handle 30, and a second gear plate 54 attached to a lower extension 42 of the cone-shaped lamp housing 40. The first and second gear plates 52, 54 matingly engage when the thumb screw 56 is tightened, thus locking the handle 30 and housing 40 in a selected angular orientation. When the thumb screw 56 is loosened, the first and second gear plates 52, 54 are free to move with respect to each other to allow the handle 30 and housing 40 to be moved to another selected angular orientation. An electric lamp or bulb 44 is secured in the housing 40 and is powered through an electrical cord 60 coupled to a power source.

In use, the utility flood light 10 may be placed on a metallic surface and held securely in position by the large magnetic base 20. The lamp housing 40 may be adjustably positioned with respect to the handle 30 in a range of at least 180 degrees and locked in the selected position by the thumb screw 56 so that the lamp 44 can be positioned to focus on any desired work area.

The large magnetic base 20 has a diameter that is about three times the diameter of the handle 30. The size and strength of the magnetic base 20 is important since it securely attaches the flood light 10 to any metallic surface. Also, the ability to point the lamp housing 40, and thus the light beam, in a particular direction without it moving is important.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A utility flood light, comprising:

a large magnetic base;

a generally cylindrical handle attached to and extending up from the base and having an extension formed on one end thereof;

a cone-shaped housing pivotally attached to the handle and being movable with respect thereto and having an extension formed on one end thereof;

a locking mechanism having a first gear plate attached to the handle extension and a second gear plate attached to the housing extension, the first and second gear plates being selectively matingly engaged to lock the handle in a selected vertically angular orientation with respect to the housing;

an electric lamp secured within the housing; and a power source electrically coupled to the lamp.

2. The utility flood light of claim 1 wherein the housing is pivotally movable with respect to the handle in a range of at least 180 degrees.

3. The utility flood light of claim 1 wherein the magnetic base extends laterally out from the handle and has a diameter about three times as large as the handle.

* * * * *